US009371573B2

(12) United States Patent
Cakir et al.

(10) Patent No.: US 9,371,573 B2
(45) Date of Patent: Jun. 21, 2016

(54) GRAIN REFINEMENT, ALUMINIUM FOUNDRY ALLOYS

(71) Applicant: TUBITAK, Ankara (TR)

(72) Inventors: Osman Cakir, Kocaeli (TR); Fahri Alageyik, Kocaeli (TR); Yucel Birol, Kocaeli (TR)

(73) Assignee: TUBITAK, Ankara (TR)

( * ) Notice: Subject to any disclaimer, the term of this patent is extended or adjusted under 35 U.S.C. 154(b) by 104 days.

(21) Appl. No.: 14/358,726

(22) PCT Filed: Nov. 16, 2012

(86) PCT No.: PCT/IB2012/056510

§ 371 (c)(1),
(2) Date: May 15, 2014

(87) PCT Pub. No.: WO2013/072898

PCT Pub. Date: May 23, 2015

(65) Prior Publication Data

US 2015/0082947 A1 Mar. 26, 2015

(30) Foreign Application Priority Data

Nov. 18, 2011 (TR) ..... a 2011/11433

(51) Int. Cl.

| | |
|---|---|
| ***C22C 1/02*** | (2006.01) |
| ***C22C 1/03*** | (2006.01) |
| ***C22C 21/04*** | (2006.01) |
| ***C22C 21/06*** | (2006.01) |
| ***C22C 21/02*** | (2006.01) |
| ***C22C 21/00*** | (2006.01) |

(Continued)

(52) U.S. Cl.

CPC . *C22C 21/02* (2013.01); *C22C 1/00* (2013.01); *C22C 1/026* (2013.01); *C22C 1/03* (2013.01); *C22C 21/00* (2013.01); *C22C 21/04* (2013.01); *C22C 21/06* (2013.01); *C22C 21/08* (2013.01); *C22C 21/12* (2013.01)

(58) Field of Classification Search

CPC ..... C22C 1/026; C22C 1/03; C22C 21/04; C22C 21/06; C22C 21/12

See application file for complete search history.

(56) References Cited

U.S. PATENT DOCUMENTS

2012/0227871 A1* 9/2012 Inoue ..... C22C 1/026 148/552

FOREIGN PATENT DOCUMENTS

WO WO 9920805 A1 * 4/1999 ..... C22C 1/026

OTHER PUBLICATIONS

Xi Xiao, Effects of Cooling Rate and B content on Microstructure of Near-Eutectic Al—13wt. % Si alloy, China Foundry, May 1, 2008, XP055061887, Retrieved from the Internet: URL: http:// www.foundryworld.com/uploadfile/2008111450239609.pdf [retrieved on May 6, 2013].

(Continued)

*Primary Examiner* — George Wyszomierski
*Assistant Examiner* — Tima M McGuthry Banks
(74) *Attorney, Agent, or Firm* — Gokalp Bayramoglu

(57) ABSTRACT

The present invention describes an effective grain refining practice for aluminum foundry alloys. The method described herein relies on the control of the Titanium level of the alloy to be grain refined and the addition of boron once it is melted. Boron addition can be made via Al—B master alloys as well as with boron compounds such as KBF4 salt. The boron added into the melt dissolves first and then forms the AlB2 particles that act as potent substrates for the nucleation of aluminum once solidification process starts. The Ti concentration of the alloy must be controlled below 100 ppm for this method to offer effective grain refinement. The boron becomes ineffective when the Ti concentration in the alloy is higher.

4 Claims, 2 Drawing Sheets

(51) Int. Cl.

| | |
|---|---|
| ***C22C 21/08*** | (2006.01) |
| ***C22C 21/12*** | (2006.01) |
| ***C22C 1/00*** | (2006.01) |

(56) References Cited

OTHER PUBLICATIONS

Yuan Liu, Grain refining mechanism of Al-3B master alloy on hypoeutectic Al-So alloys, Transactions of Nonferrous Metals Society of China, vol. 21, No. 7, Jul. 1, 2007, pp. 1435-1440, XP055061899.

Y Birol, Interaction of grain refinement with B and modification with Sr in aluminium foundry alloys, Materials Science and Technology, vol. 28, No. 1, Jan. 1, 2012, pp. 70-76, XP055061947.

G K Sinworth, Grain Refinement of Aluminium Casting Alloys, AFS Transactions 2007 American Foundry Association, Jan. 1 2007, XP055061889, Retrieved from the Internet: URL: http:// files.www.engineering.com [retrieved on May 6, 2013].

* cited by examiner

GRAIN REFINEMENT, ALUMINIUM FOUNDRY ALLOYS

TECHNICAL FIELD ADDRESSED BY THE PRESENT INVENTION

The present invention describes an effective grain refinement practice for aluminium foundry alloys. The grain refinement obtained with this novel practice is far better than that possible with the current art.

The practice described herein is based on the control of Ti level in aluminium foundry alloys and the addition of boron after melting. Boron addition can be made either through the addition of Al—B based master alloys or boron-bearing compounds such as the KBF4 salt. Boron dissolves in the molten alloy soon after the addition and forms effective substrates for heterogeneous nucleation of aluminium once solidification starts. The Ti level of the melt must be less than 100 ppm for this practice to be effective. Boron addition becomes ineffective if the Ti level is higher.

The grain size after solidification is extremely small once these conditions are met. Grain refinement, unlikely with the current art is readily obtained with as much as 200 ppm boron addition. The average grain diameter of aluminium foundry alloys grain refined with this novel practice was found to be invariably less than 200 microns. This level of grain refinement represents at least a two-fold improvement with respect to that obtained with the current art.

The present method offers additional benefits with respect to the current art. The fading of the effectiveness of grain refinement, typical of the current art, is not a problem in the present method since the nucleating agents are not insoluble, but instead, soluble borides and form only shortly after the solidification process starts. In the current art, on the other hand, the nucleating agents are insoluble borides and suffer either floatation or settlement depending on whether their density values are lower or higher than that of molten aluminium, respectively. The loss of the grain refinement capacity, i.e. fading, is a major shortcoming of the current art and is elegantly taken care of with the method of the present invention.

A further advantage of the present invention is that the grain refinement offered is still effective in remelting operations. However, in order to achieve grain refinement repeatedly in remelting operations, one has to avoid the enrichment of the molten alloy with Ti.

Al—Si, Al—Cu and Al—Mg based foundry alloys can be successfully grain refined with the method of the present invention provided that their Titanium levels are controlled below 100 ppm and their compositions are adjusted so as to maintain their melting points below 639 centrigade.

TECHNICAL PROBLEM THE PRESENT INVENTION ADDRESSES

Grain refinement is one of the most critical technological treatments in aluminium foundries. A cast structure with fine grains imparts to a casting superior toughness and strength properties while improving the formability and the surface quality. Grain refinement not only improves the casting quality but also the efficiency of the casting process.

Master alloys produced from the ternary Al—Ti—B alloy system are employed in the grain refinement of aluminium foundry alloys. Al-5Ti-1B master alloy that contains insoluble TiB2 particles, in addition to the soluble Al3Ti particles owing to an excess amount of Ti (Ti:B>2.2) is the most popular. This master alloy has become the Standard grain refiner for aluminium industry and is added into molten aluminium in the form of a rod. It provides exceptionally small grains provided that the melt does not contain transition elements (Zr, Cr etc.) whose borides are more stable than that of aluminium. However, while its performance is outstanding with wrought alloys produced with the continuous and semi-continuous casting Technologies, it is far from expectations in shape casting of aluminium foundry alloys. This poor performance is linked with the poisoning by Si which is present in the foundry alloys at much higher levels (Si poisoning). Si reacts with Ti and forms Ti—Si Compounds and thus reduces the population and the effectiveness of the $Al_3Ti$ and $TiB_2$ particles.

All of the commercial grain refining master alloys used in aluminium foundries today are produced from the Al—Ti—B alloy system. However, Al—B alloys do a much better job in refining the grain structure of aluminium foundry alloys than the Al—Ti—B master alloys (In contrast to the Ti-bearing compound particles, AlB2 particles perform better when there is Si in the alloy). In spite of this, Al—B alloys are employed to precipitate transition elements in the production of high conductivity aluminium, rather than in the grain refinement of aluminium foundry alloys. Al—B alloys were claimed to produce inconsistent performance on an industrial scale, although their superiority was confirmed in laboratory studies. Meanwhile, foundry alloys suffer much bigger grains while wrought aluminium alloys enjoy grain sizes well below 200 microns. However, much smaller grains than that obtained with the current art can be achieved in foundry alloys. Grain refiner master alloys currently available in the market were developed for the continuous casting of wrought alloys and fail to meet the expectations of the producers of aluminium castings.

In summary, superior grain refiners offering a better performance in refining the grain structure of Al—Si foundry alloys is needed.

The present invention describes a novel method capable of providing grain structures smaller than those possible with the current art.

STATE OF THE PRESENT ART

A fine equiaxed grain structure is essential for a high quality casting while a sound grain refinement practice is a must for an efficient and successful casting operation. Aluminium alloys are known to be grain refined with Ti additions thanks to a peritectic reaction in the Al—Ti binary system that provides $Al_3Ti$ particles which in turn nucleate aluminium [1-2]. However, for this mechanism to work, the Ti level in the melt must be at the peritectic composition, in other words, very high (as much as 0.15 wt %) [1-4]. Investigations carried out in 1940-1950's have shown that when boron is added in to the melt together with Ti, the grain refinement effect is markedly improved and the same level of grain refinement is possible at much lower Ti concentrations [5]. Hence, the commercial grain refiners today are produced invariably from the Al—Ti—B alloy system.

Commercial grain refiners employed in aluminium foundries worldwide contain 2 to 5 wt % Ti and 0.1 to 1 wt % B. The mechanisms involved in the grain refinement with these alloys can be found in the proceedings of various conferences (TMS Light Metals and AFS Transactions, [6,7]), in peer reviewed international journals while information on grain refining master alloys and their production methods are disclosed in numerous patents [8-23]. The microstructure of Al—Ti—B grain refiners consists of $TiB_2$ and $Al_3Ti$ particles dispersed in an aluminium matrix [24]. The aluminium matrix dissolves while the $TiB_2$ and $Al_3Ti$ particles are released into the melt soon after the addition of the grain refiner into the melt. $TiB_2$ particles are engaged in the nucleation of aluminium while the $Al_3Ti$ coats the $TiB_2$ particles in the form of a very thin layer [25]. $Al_3Ti$ particles offer another contribution. The solute Ti made available in the melt upon the dissolution of $Al_3Ti$ particles, offer a growth restriction effect as they need to be partitioned between the solid and liquid phases before the solidification front can advance. This is essentially why Ti is regarded as one of the most powerful growth restricting elements. While this mechanism is generally accepted, there are many models and theories developed to explain the mechanisms involved in grain refinement [25-29]. These models and theories offer different mechanisms but they all agree on the grain refinement capacity and capability of Al—Ti—B alloys. Thanks to an outstanding performance confirmed by laboratory studies, grain refinement of aluminium alloys with the addition of Al-T-B master alloys has become a well established practice.

Among many alloys from the Al—Ti—B system, Al-5Ti-1B that contains an excess amount of Ti (Ti:B>2.2) and thus introduces into the melt, in addition to the insoluble TiB2 particles, the soluble Al3Ti particles, is the most popular. Al-5Ti-1B master alloy has become the Standard grain refiner in aluminium foundries and is added into molten aluminium continuously in the form of rod. It offers a remarkable grain refinement performance unless the alloy to be grain refined contains one or more of the transition elements (Zr, Cr etc) whose borides are more stable than TiB2 [30].

However, both the Al-5Ti-1B grain refiner and the other grain refiners from the Al—Ti—B system have been developed for the continuous casting (twin roll casting/strip casting) or semi-continuous DC casting of wrought aluminium alloy ingots and billets (1XXX, 2XXX, 3XXX, 5XXX, 6XXX ve 8XXX). However, these grain refiners that offer a great performance for wrought aluminium alloys are not nearly as good with the aluminium foundry alloys [31,32]. There are substantial differences between the shape casting of aluminium foundry alloys and the continuous casting of wrought aluminium alloys. The undercooling before solidification is considerable in shape casting. While solidification is complete within minutes of inoculation in continuous casting, it could take hours in shape casting. The melt composition may change in the latter and the nucleating agents introduced into the melt may be removed via settlement. Direct chill casting of ingots and billets and twin roll and twin belt casting of strip relies on commercial purity aluminium where as aluminium foundries who employ shape casting uses pre-alloyed material often with considerable levels of residual titanium.

However, the single most important difference between the two manufacturing routes is the difference between the chemistries of the wrought and foundry alloys. Almost all foundry alloys contain high levels of silicon in order to improve castability and thus to control shrinkage and to avoid hot tearing. Silicon improves fluidity and renders sound casting of even the thinnest sections possible; forms a natural composite and improves mechanical properties and makes the aluminium alloy even lighter. However, Si reacts with Ti thereby reducing the population and effectiveness of Al3Ti and TiB2 particles and impairs the grain refining performance when it is more than 3 wt % [33-36]. Hence, it is relatively more difficult to grain refine Al—Si based foundry alloys than wrought grades. While the Al-5Ti-1B addition rates with wrought alloys are typically 0.005-0.01 wt %, Al—Si foundry alloys require at least 10 times more of the same grain refiner. Excessive addition of the grain refiner does compensate for the loss of the grain refining capacity, but is not desirable as it introduces several disadvantages. First of all, such a practice is not cost-effective. Besides, high levels of Ti thus introduced into the melt, deteriorates the electrical conductivity of aluminium alloy that is regarded as a very attractive property of aluminium in most applications. Search for alternative grain refiners has thus become very significant [37].

Al—Ti—B based grain refiners relatively richer in boron than the commercial grades have been proposed to grain refine aluminium foundry alloys [38]. (Al,Ti)B2 and AlB2 particles are expected to engage in heterogeneous nucleation in these types of grain refiners. While AlB2 particles fail to offer any grain refinement in commercial purity aluminium, they become effective when there is dissolved silicon in the aluminium melt. Al—B based grain refiner alloys have been shown to be more effective than Al—Ti—B based grain refiners in aluminium foundry alloys [38]. Boron addition is effective when there is silicon in the alloy whereas it is of no use in commercial purity aluminium [38].

The quality expectations in automotive structural castings have been steadily increasing. Grain refinement is a key practice in aluminium foundries to meet these expectations. The grain refiners available in the market today are not suitable for the shape casting of aluminium foundry alloys. Hence, the problems encountered in the aluminium foundries that produce aluminium castings are still waiting for a solution. Aluminium foundries need more potent grain refiners than those available in the market for castings to enjoy higher fluidity and castability, a uniform distribution of shrinkage porosity and secondary phases, better surface quality, superior mechanical properties including improved fatigue resistance, better working characteristics, soundness and integrity.

DETAILED DESCRIPTION OF THE INVENTION

The grain structures of the grain refined Al—Si alloys are illustrated in FIG. 1 while the average grain sizes of the alloys before and after the grain refiner addition are shown in FIG. 2. It is seen that commercial purity aluminium cannot be grain refined with Boron addition. Al—Si alloys with up to 3 wt % Si cannot be grain refined with boron either. However, the improvement in grain structure upon the addition of boron in Al—Si alloys with higher levels of Si is evident. The grain size of these hypo-eutectic Al—Si alloys decrease with increasing Silicon with the addition of as much as 200 ppm Boron. This range of Silicon levels cover the entire series of Al—Si based foundry alloys. The majority of aluminium foundry alloys contain at least 5 wt % Si.

The only condition for refining the grain structure with this method is the formation of AlB2 particles before the aluminium starts to solidify. The liquidus temperature at which AlB2 starts to crystallize from the melt is estimated from the Al—Si—B ternary system to be 639 centigrade at a boron concentration of 0.02 wt %. Hence, Al—Si, Al—Cu and Al—Mg alloys that start to solidify below approximately 639 centigrade can be grain refined with boron at an addition rate of 0.02 wt %.

In summary, grain refinement of Al—Si foundry alloys upon the addition of boron occurs through the effective heterogeneous nucleation of aluminium on AlB2 particles. AlB2 is not a stable compound in Al—Si melts at typical boron addition rates of 0.02 wt %. This feature of boron addition is different from that of TiB2 particles introduced with the Al—Ti—B based grain refiners. AlB2 particles form in the melt only when the solidification process starts and provide the potent substrates for the nucleation of aluminium. Hence, AlB2 is an effective substrate for all alloys where the solidification of aluminium follows AlB2 formation. This condition is readily satisfied in Al—Si with approximately 4 wt % Si. This Si level covers more or less the composition of the entire set of Al—Si foundry alloys.

356 and 357 aluminium foundry alloys with less than 0.01 wt % Ti, could be effectively grain refined with 0.02 wt % boron addition, offering an average grain size after solidification of approximately 100 microns. This grain size is at least two times smaller than the average grain size obtained in aluminium foundry alloys with the present art and provides in foundry alloys that are normally typical of wrought alloys.

The method described in this invention involves the control of Titanium below 0.01 wt % in the alloy to be grain refined and the addition of 0.02 wt % Boron into the alloy melt shortly before casting. Boron addition could be achieved with Al—B based master alloys regardless of boron content as well as with boron compounds such as KBF4 salt, boron oxide, borax as long as the final boron level in the melt is 0.02 wt %.

Since, the solidification of aluminium must follow the formation of AlB2 particles for effective grain refinement in this practice, Al—Cu and Al—Mg alloys that start to solidify below approximately 639 centigrade can also be grained with this method.

The grain size after solidification is extremely fine and the average grain size is invariably below 200 microns once these conditions are met.

Today, Al—Ti—B based grain refiners are employed in the grain refinement of aluminium foundry alloys.

Grain refinement is achieved in the present invention with the addition of Boron into the aluminium alloy. The control of titanium level in the alloy to be grain refined is just as important as boron addition for an effective grain refinement. The effectiveness of boron addition is severely impaired when titanium control is ignored and titanium in the alloy exceeds 0.01 wt %.

EXAMPLE

Grain refinement experiments were performed with the commercial and Ti-free AlSi7Mg alloys. The Ti-free AlSi7Mg alloy was prepared in an electric resistance furnace by melting commercial purity aluminium (99.7 wt % Al) and adding elemental silicon and finally maintaining the temperature of the melt at 720 centigrade. The alloy melts thus obtained were inoculated with Al-5Ti-1B and Boron additions. Boron addition was made with an Al-3B master alloy as well as with KBF4 salt. Reference samples were taken before boron additions in every test. AlTi5B1 and Al-3B master alloy and KBF4 additions were made so as to bring the Boron concentration of the melt to 200 ppm Boron. The melt was stirred with a graphite rod for 20 seconds after these additions and the inoculated melt was sampled 2, 5, 10, 15, 30 and 60 minutes later. These samples were solidified inside copper based permanent moulds with a diameter of 25 mm and a height of 50 mm. Measures were taken to maintain the temperature of the melt at 720 ±10 centigrade throughout these experiments.

These samples were sectioned 20 mm from the bottom surface and were prepared with standard metallography practices for grain size measurements. They were etched with Poulton's reagent and were subsequently examined with an optical microscope. These samples were also anodized in Barker's solution (5 ml HBF4 (48%) and 200 ml distilled water) and were examined with an optical microscope under polarized light. The grain size measurements were performed with the linear intercept method according to the ASTM E112-88 standard.

The grain structures before and after grain refiner additions are shown in FIG. 3. A modest grain refinement effect is observed in samples inoculated with the standard A1Ti5B1 grain refiner (FIG. 3*a*). The grain refining effect of the Al-3B grain refiner in the case of the commercial AlSi7Mg alloy is very similar (FIG. 3*b*). However, the performance of the Al-3B grain refiner with the Ti-free AlSi7Mg alloy is markedly better (FIG. 3*c*). Grain size measurements from these experiments are illustrated in FIG. 3*d* and show the remarkable improvement in grain refinement with 200 ppm Boron addition in the Ti-free aluminium foundry alloys. This performance is much better than that obtained with the present art.

REFERENCES

Figure 1:
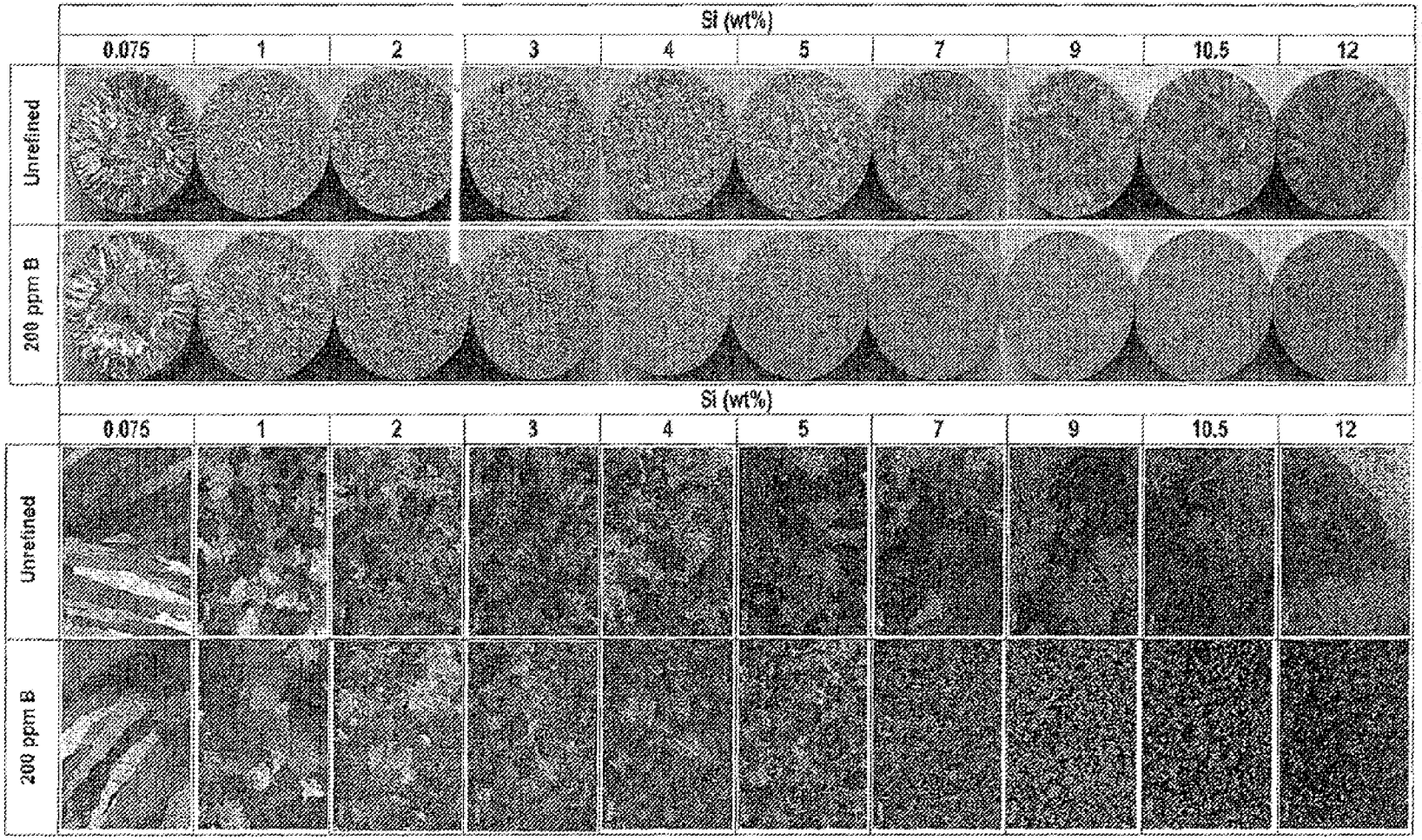
FIG. 1—Grain structure of grain refined Al—Si alloys
Figure 2:
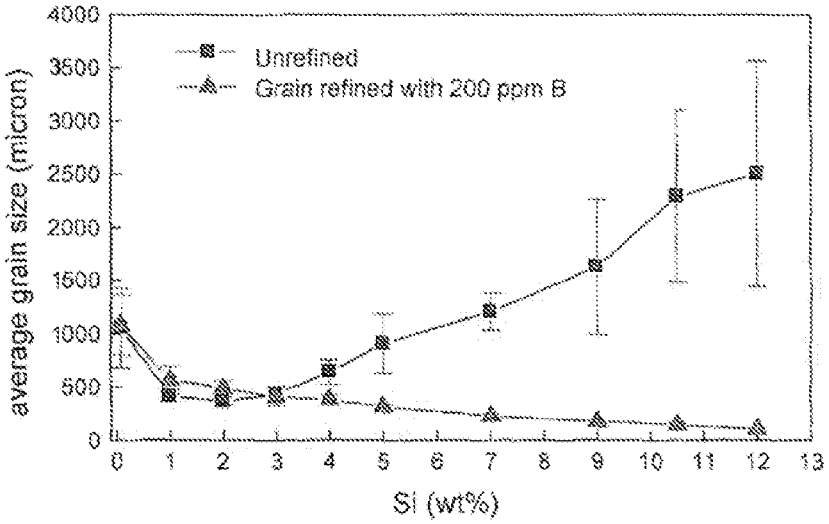
FIG. 2—Average grain sizes; together with reference samples
Figure 3:
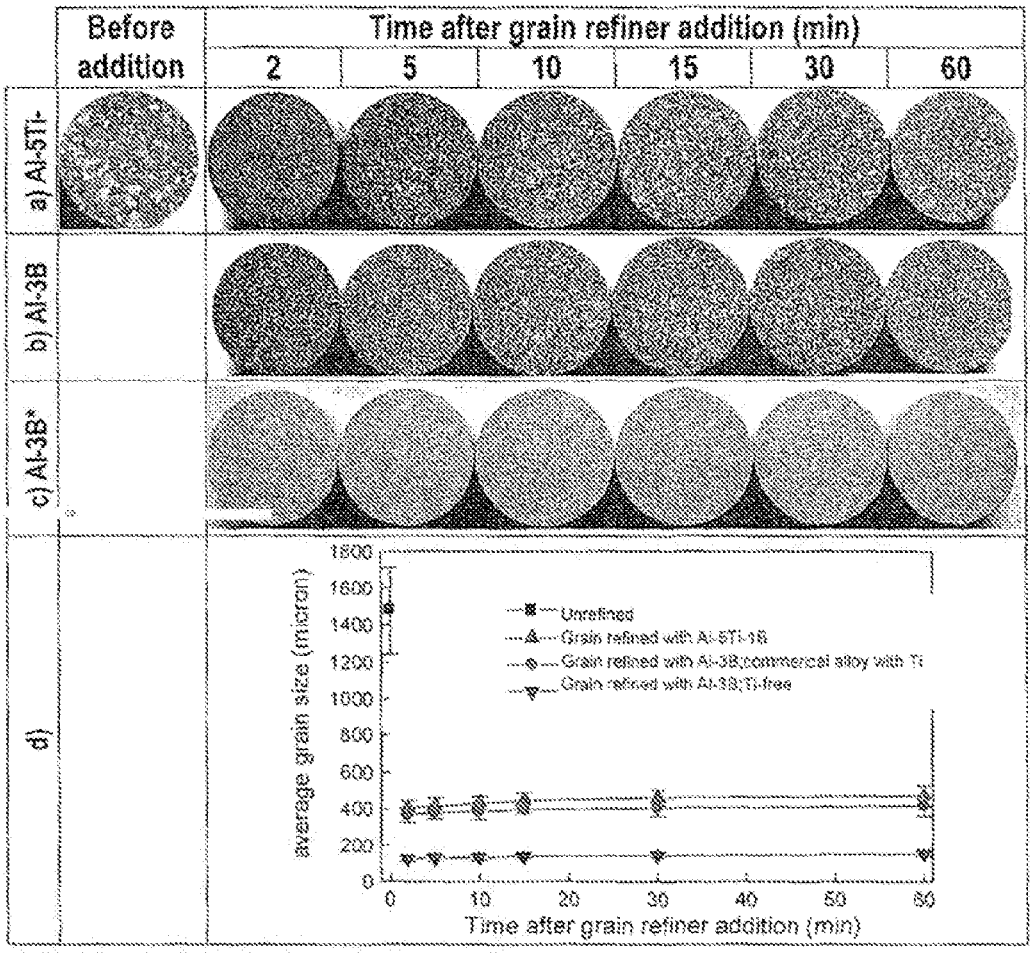
FIG. 3—Grain structures of AlSi7Mg alloys before and after the addition of grain refiner master alloys a) Grain refined with AlTi5B1 b) Grain refined with Al-3B c) Ti-free AlSi7Mg alloy grain refined with Al-3B d) Grain size measurements in the above set of experiments

1. CROSSLEY, P. B. and MONDOLFO, L. F., Mechanism of grain refinement in aluminium alloys, Transactions AIME, 191, 1143-1148 (1951)

2. MAXWELL, I. and HELLAWELL, A., A simple model for grain refinement during solidification, Acta Metall., 23, 229-237 (1975).

3. DAVIS, G., DENNIS, J. M. and HELLAWELL, A., The Nucleation of Aluminum Grains in Alloys of Aluminum with Titanium and Boron, Metall. Trans.. 1, 275-280 (1970).

4. ARNBERG, L., BACKERUD, L., KLANG, H., "Grain refinement of aluminum 1: Production and . . . Titanium and Boron", Metallurgical Transactions, 2, 465-471, (1971).

5. CIBULA, A., The Grain Refinement of Aluminum Alloy Castings by Additions of Titanium and Boron," The Journal of the Inst. of Metals, 80, 1-16, (1951-52).

6. TMS Light Metals Proceedings, 1982-2009.

7. AFS Transactions, 1978-2009.

8. BACKERUD, S.L., Method for Producing a Master Alloy for Use in Aluminium Casting Processes, U.S. Pat. No. 3,785,807, (1974).

9. MIYASAKA, Y., Small Grain Promoting Aluminium-Titanium-Boron Mother Alloy, U.S. Pat. No. 3,857,705, (1974).

10. LANGDON, C. R., BURKART, A. R., Aluminum-titanium-boron master alloy, U.S. Pat. No. 4,298,408, (1981).

11. HOFF, J. C., Introducing a Grain Refining or Alloying Agent into Molten Metals and Alloys, U.S. Pat. No. 3,634, 075, (1972).

12. CHANDLEY, G. D., Apparatus and process for countergravity casting of metal with air exclusion, U.S. Pat. No. 5,042,561, (1991).

13. SIGWORTH, G. K., Third element additions to aluminum-titanium master alloys, U.S. Pat. No. 4,873,054, (1989).

14. BACKERUD, L., KIUSALAAS, R., KLANG, H., VADER, M., NOORDEGRAAF, J., NAGELVOORT, E. H. K., Method for production of master alloys for grain refining treatment of aluminum melts, U.S. Pat. No. 5,104,616, (1992).

15. MCCARTNEY, D. G., Grain refining of aluminium and its alloys using inoculants, Int. Mater. Rev., 34, 247-260, (1989).

16. DAVIES, P., KELLIE, JAMES, L. F., PARTON, D. P., WOOD, J. V., Metal matrix alloys, U.S. Pat. No. 6,228,185, (2001).

17. MURTY, B. S., KORI, S. A. and CHAKRABORTY, M., Grain refinement of aluminium and its alloys by heterogeneous nucleation and alloying , Int. Mater.Rev., 47, 3-29, (2002).

18. ALLIOT, M., BEGUIN, J. C., MOUTACH, M., PERCHERON, J.C., Mother alloy of aluminum, titanium and boron and process for fabrication, U.S. Pat. No. 3,961,995, (1976)

19. YOUNG, D. K., SETZER, W. C., KOCH, F. P., RAPP, R. A., PRYOR, M. J., JARRETT, N., Aluminum base alloy and method for preparing same U.S. Pat. Nos. 5,415,708, (1995).

20. YOUNG, D. K., SETZER, W. C., KOCH, F. P., RAPP, R. A., PRYOR, M. J., JARRETT, N., Aluminum base alloy, US Pat. Nos. 5,484,493, (1996).

21. BIROL, Y., A novel Al—Ti—B alloy for grain refining Al—Si foundry alloys, Journal of Alloys and Compounds, 486, 1-2, 219-222, (2009).

22. BIROL, Y., An improved practice to manufacture Al—Ti—B master alloys by reacting halide salts with molten aluminium, Journal of Alloys and Compounds, 420, 71-76, (2006).

23. BIROL, Y., patent pending"Process for Producing a Grain Refining Master Alloy", WO/2007/052174 (2007).

24. LEE, M. S. and TERRY, B. S., Effects of processing parameters on aluminide morphology in aluminium grain refining master alloys, Mater. Sci. Tech., 7, 608-612 (1991).

25. MOHANTY, P. S., Guthrie, R. L., Gruzleski, J. E., Studies on the fading behaviour of Al—Ti—B master alloys and grain refinement mechanism using LiMCA, Light Metals, 1995, 859-868, (1995).

26. ARNBERG, L., BACKERUD, L., KLANG, H., Grain Refinement of Aluminium—1. Production and Properties of Master Alloys of Al—Ti—B Type and Their Ability to Grain Refine Aluminium, Metals Tech., 9,1-6, (1982).

27. PEARSON, J. and BIRTH, M. E. J., Effect of The Titanium:Boron Ratio on the Efficiency of Aluminum Grain-Refining Alloys, J. Metals, 31, 11, 27-31, (1979).

28. JONES, G. P. and PEARSON, J., Factors affecting the grain-refinement of aluminum using titanium and boron additives, Metall. Trans., 7B, 6, 223.-234, (1976).

29. MOHANTY, P. S. and GRUZLESKI, J. E., Mechanism of Grain Refinement in Aluminum, Acta Metall., 3, 2001-2012, (1995).

30. BIROL, Y., Grain refining efficiency of Al—Ti—C alloys, Journal of Alloys and Compounds, 422, 128-131, (2006).

31. EASTON, M. A. and STJOHN, D. H., An analysis of the relationship between grain size, solute content, and the potency and number density of nucleant particles, Metall. Mater. Trans. A, 36A, 1911-1920, (2005).

32. LEE, Y. C., DAHLE, A. K., STJOHN, D. H., HUTT, J. E. C., The effect of grain refinement and silicon content on grain formation in hypoeutectic Al—Si alloys , Mat. Sci. Eng. A259, 43-52, (1999).

33. SIGWORTH G. K. and GUZOWSKI, M. M., Grain refining of hypoeutectic Al—Si alloys, AFS. Trans. 93, 907-913 (1985).

34. SPITTLE, J. A., SADLI, S., Effect of Alloy variables on Grain Refinement of Binary Aluminium Alloys with Al—Ti—B, Mater. Sci. Tech. 11, 533-537, (1995).

35. MOHANTY, P. S. and GRUZLESKI, J. E., Grain refinement mechanisms of hypoeutectic Al—Si alloys, Acta Mater. 44, 3749-3760 (1196).

36. MOHANTY, P. S. SAMUEL F. H. and GRUZLESKI, J. E., Studies on addition of inclusions to molten aluminum using a novel technique, Metall. Trans. B. 26, 103-109, (1995).

37. BIROL, Y., Response to thermal exposure of the mechanically alloyed Al/C powder blends , J. Alloy Compd. 460, 1-2, L1-L5, (2008).

38. LU, H. T., WANG, C., KUNG, S. K., J. Chinese Foundryman's Association, 29, 10, (1981).

The invention claimed is:

1. A novel method to refine the grain structures of aluminum foundry alloy, consisting of the following steps, melting the aluminum foundry alloy in a furnace;

adding 0.02 wt % boron into the furnace;

wherein a Ti concentration of the aluminum foundry alloy to be grain refined is controlled below 0.01 wt %: the 0.02 wt % boron is added in a form of an Al—B master alloy.

2. The novel method of claim 1, wherein the grain structure is an Al—Si based foundry alloy with sufficient silicon to depress the liquidus point to approximately 639 centigrade.

3. The novel method of claim 1, wherein the grain structure is an Al—Cu based foundry alloy with sufficient cooper to depress the liquidus point to approximately 639 centigrade.

4. The novel method of claim 1, wherein the grain structure is an Al—Mg based foundry alloy with sufficient magnesium to depress the liquidus point to approximately 639 centigrade.

* * * * *